US009896791B2

(12) United States Patent
Yamauchi et al.

(10) Patent No.: US 9,896,791 B2
(45) Date of Patent: Feb. 20, 2018

(54) PINCUSHION

(71) Applicant: CLOVER MFG. CO., LTD., Osaka-shi, Osaka (JP)

(72) Inventors: Eri Yamauchi, Osaka (JP); Katsuhiko Ozeki, Osaka (JP)

(73) Assignee: CLOVER MFG. CO., LTD., Osaka (JP)

( * ) Notice: Subject to any disclaimer, the term of this patent is extended or adjusted under 35 U.S.C. 154(b) by 0 days.

(21) Appl. No.: 15/132,980

(22) Filed: Apr. 19, 2016

(65) Prior Publication Data

US 2016/0340816 A1 Nov. 24, 2016

(30) Foreign Application Priority Data

May 18, 2015 (JP) ..... 2015-100884

(51) Int. Cl.

| | |
|---|---|
| ***A41H 31/00*** | (2006.01) |
| ***D05B 91/12*** | (2006.01) |
| ***A41H 17/00*** | (2006.01) |

(52) U.S. Cl.

CPC ..... *D05B 91/12* (2013.01); *A41H 17/00* (2013.01)

(58) Field of Classification Search

CPC ..... A41H 17/00; D05B 91/12; D05B 91/14
USPC ..... 223/108, 109 R
See application file for complete search history.

(56) References Cited

U.S. PATENT DOCUMENTS

| | | | | | |
|---|---|---|---|---|---|
| 406,340 | A * | 7/1889 | Day | D05B 91/12 | 223/109 R |
| 1,460,326 | A * | 6/1923 | Jewart | D05B 91/12 | 223/109 R |
| 1,725,999 | A * | 8/1929 | Ryder | D05B 91/12 | 223/109 R |
| 1,742,696 | A * | 1/1930 | Eddy | D05B 91/12 | 223/109 R |
| 1,788,420 | A * | 1/1931 | Blumberg | A41H 17/00 | 223/109 R |
| 2,426,329 | A * | 8/1947 | Williams | D05B 91/12 | 223/109 R |
| 3,344,967 | A | 10/1967 | Kelly | | |
| 5,002,211 | A * | 3/1991 | Caldwell | D05B 91/14 | 223/106 |
| 6,547,109 | B1 * | 4/2003 | Kim | A41H 17/00 | 223/109 R |

* cited by examiner

*Primary Examiner* — Nathan Durham
(74) *Attorney, Agent, or Firm* — Hamre, Schumann, Mueller & Larson, P.C.

(57) ABSTRACT

A pincushion includes an inner container, a cushioning material, a flexible sheet material, an elastic ring member and a cylindrical outer cover. The inner container has a bottom wall portion and a side wall portion standing upright from the bottom wall portion. The side wall portion has an opening at its upper part. The cushioning material is provided in the inner container. The sheet material covers part of the cushioning material that projects upward from the opening of the side wall portion. The ring member is fitted onto the side wall portion of the inner container with the hem of the sheet material interposed between the ring member and the side wall portion. The outer cover is fitted around the side wall portion of the inner container such that its inner face is in contact with the elastic ring member.

6 Claims, 2 Drawing Sheets

PINCUSHION

BACKGROUND OF THE INVENTION

1. Field of the Invention

The present invention relates to a pincushion.

2. Description of Related Art

As described in U.S. Pat. No. 3,344,967, for example, pincushions have a basic configuration in which a resiliently compressed cushioning material such as cotton, wool, or sponge is wrapped in a cloth to form a rounded soft pincushion face, and are used to hold needles for handicrafts in a state where the needles are stuck into the pincushion face.

According to the pincushion described in U.S. Pat. No. 3,344,967, the shape of the pincushion surface is adjusted by fitting a ring onto a hem of the cloth wrapping the cushioning material, and auxiliary rings for fixing are put on the upper side and the lower side of the ring in an overlapping manner in order to prevent the ring from coming off in the vertical direction. The vertical positions of the upper rings are fixed by pulling downward a wire whose end is pasted to a bottom plate, and the vertical position of the lower auxiliary ring is fixed by pasting it to the circumferential portion of the bottom plate.

The configuration of the pincushion described in U.S. Pat. No. 3,344,967 cannot be easily disassembled. Thus, when a needle for handicrafts is completely buried below the cushioning material surface, it is difficult to pull out the needle. Furthermore, it is also difficult to have fun by replacing the cloth forming the pincushion surface with a cloth having a user's favorite color or pattern.

SUMMARY OF THE INVENTION

The present invention has been proposed under the above-described circumstances, and it is an object thereof to provide a pincushion that can foe easily disassembled and assembled and that allows a cloth forming a pincushion face or a cushioning material to be easily replaced.

According to an embodiment of the present invention, there is provided a pincushion that includes an inner container having at bottom wall portion and a side wall portion that stands upright from a circumferential portion of the bottom wall portion, where the the inner container has an opening at an upper portion of the side wall portion; a resiliently compressible cushioning material disposed in the inner container; a flexible sheet material covering the cushioning material at a portion thereof projecting upward from the opening of the inner container, with its hem positioned along the side wall portion of the inner container; an elastic ring member fitted onto the side wall portion of the inner container with the hem of the sheet material interposed between the ring member and the side wall portion; and a cylindrical outer cover fitted around the side wall portion of the inner container such that an inner face of the outer cover is in contact with the elastic ring member.

In a preferable embodiment, an annular groove into which the elastic ring member is to be fitted is formed on an outer circumference of the side wall portion of the inner container.

In a preferable embodiment, the cushioning material is one of cotton, wool and sponge.

In a preferable embodiment, the sheet material is a cloth.

In a preferable embodiment, the elastic ring member is made of rubber.

In a preferable embodiment, the side wall portion of the inner container has a cylindrical shape.

The flexible sheet material covers the cushioning material in a resiliently compressed state to form a rounded pincushion face. Furthermore, the hem of the sheet material is fixed by being elastically pressed by the elastic ring member against the outer face of the side wall portion of the inner container. The inner face of the outer cover is in contact with the elastic ring member, and thus, the outer cover is maintained in the state of being fitted onto the inner container by a frictional force generated between the outer cover and the elastic ring member.

The state in which the outer cover is fitted onto the inner container is maintained merely by being in contact with the elastic ring member, and thus, the outer cover can be easily detached. Also, the elastic ring member for fixing the hem of the sheet material can be easily detached. When the elastic ring member is detached, the sheet material can also be easily detached from the inner container and the cushioning material. That is to say, the thus configured pincushion can be easily disassembled and assembled without using special tools or joining means. Accordingly, when a needle for handicrafts is completely buried below the pincushion face, the buried needle can be removed by disassembling the pincushion. Furthermore, the sheet material can be easily replaced with a sheet having a user's favorite material, color, or pattern, and, furthermore, the cushioning material can be replaced with a user's favorite material.

Other features and advantages of the present, invention will become more apparent from the detailed description given below with reference to the attached drawings.

DESCRIPTION OF THE PREFERRED EMBODIMENT

Figure 1:
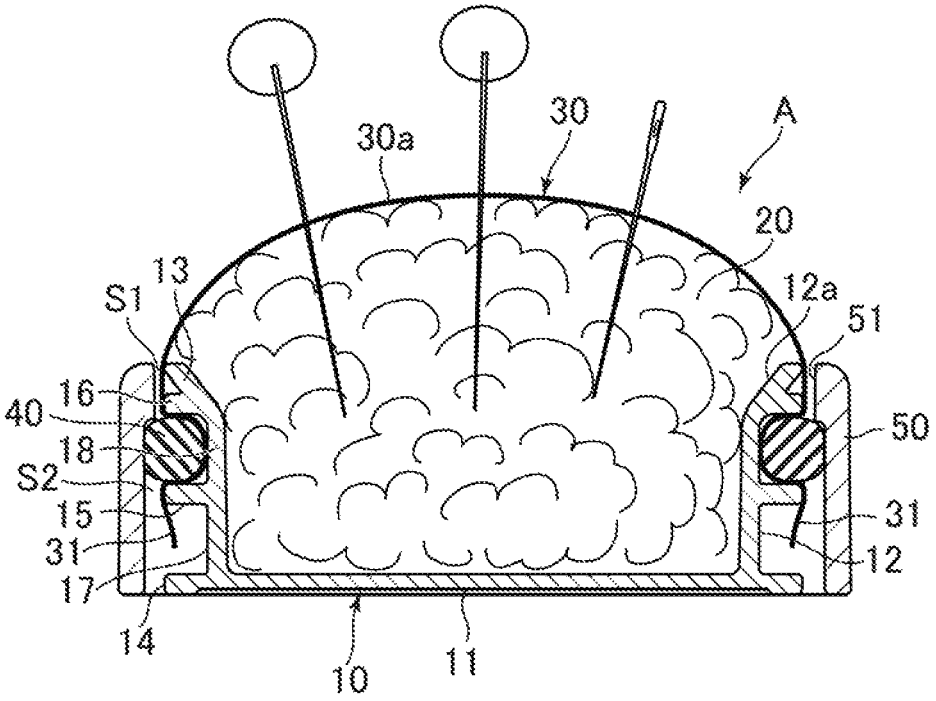
FIG. 1 is a vertical cross-sectional view of a pincushion according to an embodiment of the present invention.

Hereinafter, preferred embodiments of the present invention will be specifically described with reference to the drawings.

FIGS. 1 to 4 show a pincushion A according to an embodiment of the present invention. The pincushion A has an inner container 10, a cushioning material 20, a sheet material 30, an elastic ring member 40, and an outer cover 50.

The inner container 10 is in the shape of a bottomed cylinder with an open upper end. That is to say, the inner container 10 is configured by a bottom wall portion 11 that is in the shape of a circle and a substantially cylindrical side wall portion 12 that stands upright from a circumferential portion of the bottom wall portion 11, and is formed by, for example, resin molding. In this embodiment, the diameter of the side wall portion 12 increases toward an upper portion 12*a* thereof in the shape of a trumpet, and an upper edge of the upper portion 12*a* forms an opening 13 of the inner container 10. A first outward-oriented flange 14 that continues from the bottom wall portion 11, a second outward-oriented flange 15 that is at a middle in the vertical direction, and a third outward-oriented flange 16 that is positioned toward the upper edge are formed in one piece with the outer circumference of the side wall portion 12. The outward-oriented flanges 14, 15, and 16 have the same outermost position on their respective circumferences. The first outward-oriented flange 14 and the second outward-oriented flange 15 form a first annular groove 17, and the second outward-oriented flange 15 and the third outward-oriented flange 16 form a second annular groove 18.

The cushioning material 20 is selected from, for example, cotton, wool, sponge, and the like, and an appropriate amount thereof is placed in the inner container 10. The cotton may be any cotton such as tree cotton, wool cotton, synthetic cotton, or an analog thereof. The wool may be wool in the cotton state or in the state of gathered scrap wool yarn. The sponge is preferably a molded body in a shape that closely fits in the inner container 10 and having a rounded upper portion. As will be described later, the amount and the size of the cushioning material 20 are selected considering the fact that the cushioning material 20 is resiliently compressed to some extent when it is severed by the sheet material 30 to form, a pincushion face 30*a*.

As the sheet material 30, a material (e.g., cloth having a predetermined thickness) that is flexible and is stretchable to some extent and through which needles for handicrafts can be stuck is selected, and there is no limitation to cloth. The sheet material 30 is not limited to commercially available cloths or the like, and examples thereof include handicraft products with patchwork or embroidery. Furthermore, the sheet material 30 is not limited to cloths, and examples thereof include knitted products.

The elastic ring member 40 is, for example, a silicone rubber ring, has a circular cross-section that allows the elastic ring member 40 to be closely fitted into the second annular groove 18, and has an inner diameter that allows the elastic ring member 40 to be elastically fitted into the second annular groove 18. In this embodiment, since the second annular groove 18 is configured such that a depth dimension d is smaller than a vertical width dimension W (see FIG. 2), the outer circumferential portion of the elastic ring member 40 fitted into the second annular groove 18 is exposed outward beyond the outer circumferences of the second and third outward-oriented flanges 15 and 16 forming the second annular groove 18 (see FIGS. 1 and 4).

The outer cover 50 is in the shape of a cylinder with open ends on both sides in the vertical direction, having substantially the same inner diameter and the same outer diameter throughout the vertical direction, and having substantially the same vertical dimension as that or the inner container 10. The outer cover 50 is formed by, for example, resin molding. The outer cover 50 has an upper edge that is bent inward so that the inner diameter thereof is reduced, and a predetermined space S1 is formed between the inner circumference of a small-diameter portion 51 and the outer circumference at the upper edge of the inner container 10. Furthermore, the inner face of a general portion of the outer cover 50 has an inner diameter that is larger than the outer circumference of each of the first, second, and third outward-oriented flanges 14, 15, and 16 of the inner container 10, and a predetermined space S2 is formed between this inner face and the outer circumference of the outward-oriented flanges 14, 15, and 16. The inner face of the general portion of the outer cover 50 has an inner diameter that allows the outer cover 50 to be in contact with the elastic ring member 40 while slightly compressing the elastic ring member 40 fitted into the second annular groove 18.

Next, methods for assembling and disassembling the pincushion and actions thereof will be described.

Figure 2:
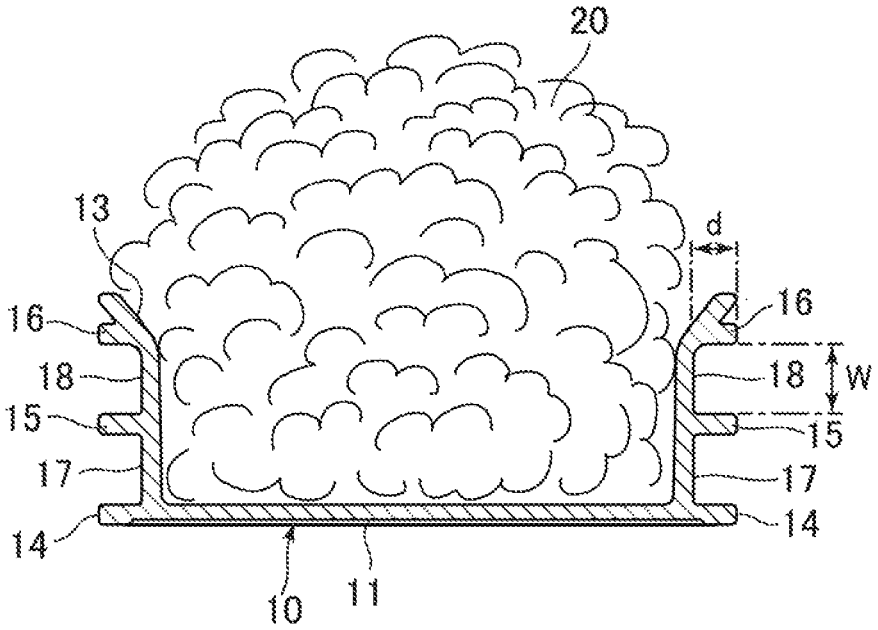
FIG. 2 is a diagram illustrating a method for assembling the pincushion shown FIG. 1.
Figure 3:
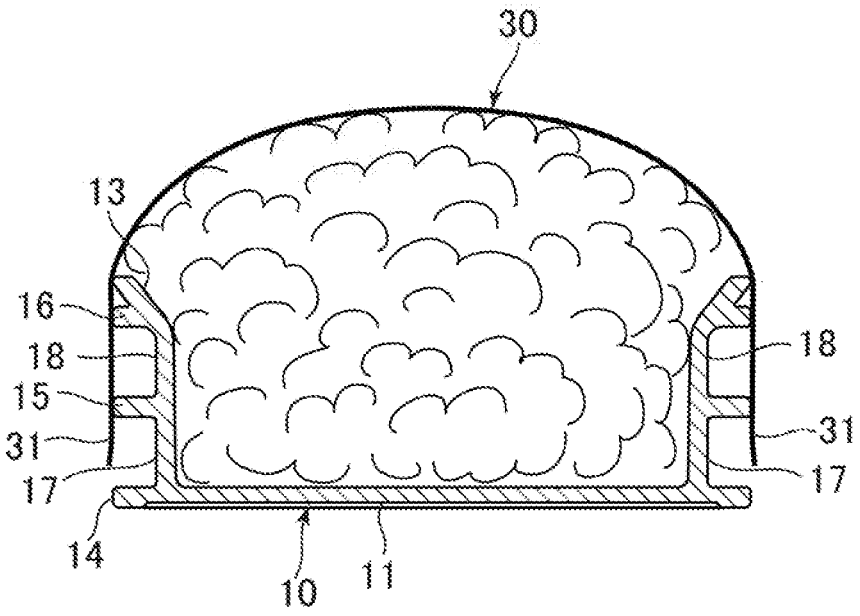
FIG. 3 is a diagram illustrating the method for assembling the pincushion shown FIG. 1.
Figure 4:
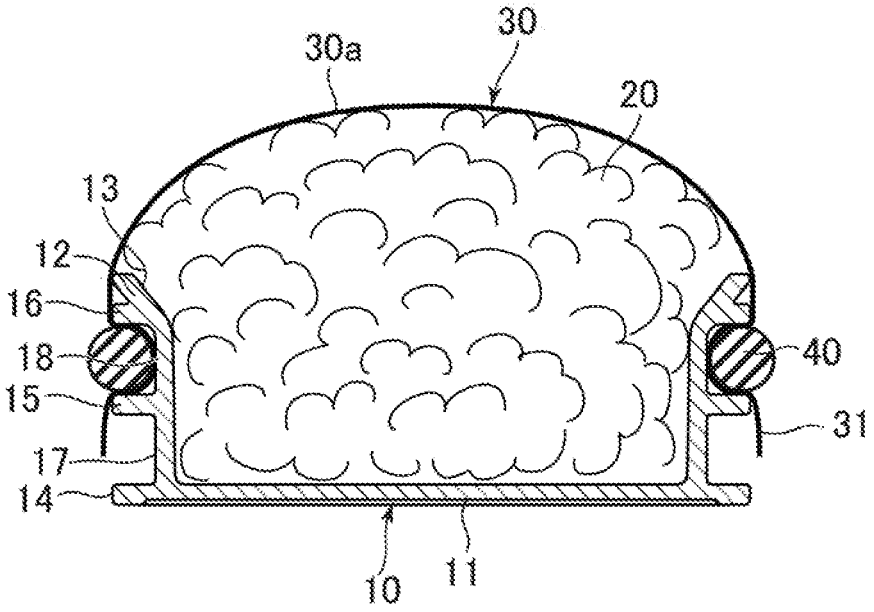
FIG. 4 is a diagram illustrating the method for assembling the pincushion shown FIG. 1.

First, as shown in FIG. 2, a predetermined amount of cushioning material 20 is placed inside the inner container 10. Then, as shown in FIG. 3, the sheet material 30 such as a cloth is placed from above to wrap the cushioning material 20, and a hem 31 of the sheet material 30 is positioned along the outer side of the side wall portion 12 of the inner container 10 in a state where the cushioning material 20 is resiliently compressed. Next, as shown in FIG. 4, the elastic ring member 40 is fitted into the second annular groove 18 from the outer side of the hem 31, so that the hem 31 of the sheet material 30 is fixed. Since the hem 31 of the sheet material 30 is curved and pressed by the elastic ring member 40 against the inner wall of the second annular groove 18, the hem 31 is firmly fixed by a fractional force generated between the sheet material 30 and the elastic ring member 40 and between the sheet material 30 and the inner face of the second annular groove 18. At that time, a portion of the hem 31 of the sheet material 30 projecting downward from the second annular groove 18 is trimmed off with scissors or the like.

The rounded surface of the thus formed sheet material 30 forms the pincushion face 30*a*. The amount of cushioning material 20 is set such that an appropriate size of the pincushion face 30*a* bulges out from, the opening 13 of the inner container 10 in a state where the cushioning material 20 is resiliently compressed as described above. The amount of pincushion face 30*a* bulging out can be adjusted by pulling the hem 31 of the sheet material 30 downward as appropriate in a state where the elastic ring member 40 is fitted from the outer side of the hem 31 as described above. In this embodiment, the diameter of the side wall portion 12 of the inner container 10 increases toward the upper portion 12*a* in the shape of a trumpet, and thus, when the cushioning material 20 is guided along this portion from the larger-diameter side, the cushioning material 20 can be smoothly placed inside the inner container 10.

Then, the outer cover 50 is fitted onto the inner container 10 such that the lower end position of the outer cover 50 is in conformity with that of the inner container 10, and, thus, the pincushion A shown in FIG. 1 is completed. At that time, the inner face of the outer cover 50 is in contact with the elastic ring member 40 while slightly compressing the elastic ring member 40, and, thus, a fractional force between the elastic ring member 40 and the inner face of the outer cover 50 prevents the outer cover 50 from being accidentally displaced with respect to the inner container 10, and the outer cover 50 is stably kept in the state of being fitted onto the inner container 10. Since the outer cover 50 has substantially the same vertical dimension as that of the inner container 10, in the assembled state, the side wall portion 12 of the inner container 10, the hem 31 of the sheet material 30, and the elastic ring member 40 can be covered up as appropriate.

The pincushion A can be disassembled by perforating the above-described assembly method in reverse order, that is, moving the outer cover 50 upward, thereby detaching the outer cover 50 from the inner container 10, and detaching the elastic ring member 40 from the second annular groove 18, thereby detaching the sheet material 30. The state in which the outer cover 50 is fitted is maintained merely by a frictional force with the elastic ring member 40, and, thus, the outer cover 50 can be easily detached with a force greater than the frictional force. Since the elastic ring member 40 can be elastically widened and deformed, the elastic ring member 40 can be easily detached from the second annular groove 18.

As described above, the pincushion A can be easily disassembled and assembled. Thus, for example, even when a needle for handicrafts is completely buried below the pincushion face 30*a*, the needle can be removed by disassembling the pincushion A.

Furthermore, the sheet material 30 can be easily replaced for fun with a sheet having a user's favorite color, pattern, or material, or with a sheet having handicraft features such as patchwork or embroidery. Furthermore, the material or amount of cushioning material 20 can be changed so that the rounded pincushion face 30*a* bulges out in any size (amount) from the opening of the inner container 10 or has any resilient hardness that the user pleases.

In this embodiment, the side wall portion 12 of the inner container 10 is provided with the first annular groove 17 below the second annular groove 18 into which the elastic ring member 40 is to be fitted, and thus, it is also possible to enjoy the pincushion A itself as a handicraft product by using a sheet having handicraft features as the sheet material 30 as described above and using this first annular groove 17 such that a decorative ribbon (not shown), a frill (not shown), or the like is attached by being wound around the first annular groove 17.

It will be appreciated that the scope of the present invention is not limited to the foregoing embodiment, and all modifications within the range as described in the claims fail within the scope of the present invention.

For example, although the inner container 10 and the outer cover 50 are circular when viewed from above in the foregoing embodiment, their shapes when viewed from above are not limited to circles, and may be any shape such an ellipse, a polygon with rounded corners, or the like.

The invention claimed is:

1. A pincushion comprising:

an inner container having a bottom wall portion and a side wall portion that stands upright from a circumferential portion of the bottom wall portion, the inner container having an opening at an upper portion of the side wall portion;

a resiliently compressible cushioning material provided in the inner container;

a flexible sheet material covering the cushioning material at a portion thereof projecting upward from the opening of the inner container, the sheet material having a lower end portion disposed along the side wall portion of the inner container;

an elastic ring member fitted onto the side wall portion of the inner container with the lower end portion of the sheet material interposed between the ring member and the side wall portion; and a cylindrical outer cover fitted around the side wall portion of the inner container, wherein the side wall portion of the inner container has an outer circumference formed with an annular groove into which the elastic ring member is fitted in a manner such that a portion of the elastic ring member protrudes from the annular groove and an inner face of the outer cover is in contact with the elastic ring member, and wherein an inner diameter of the cylindrical outer cover is smaller than an outer diameter of the elastic ring member when the elastic ring member is fitted into the annular groove.

2. The pincushion according to claim 1, wherein the cushioning material is one of cotton, wool and sponge.

3. The pincushion according to claim 1, wherein the sheet material is a cloth.

4. The pincushion according to claim 1, wherein the elastic ring member is made of rubber.

5. The pincushion according to claim 1, wherein the side wall portion of the inner container has a cylindrical shape.

6. The pincushion according to claim 1, wherein the elastic ring member is compressed by the inner face of the outer cover.

* * * * *